United States Patent [19]

McCray et al.

[11] 4,222,418

[45] Sep. 16, 1980

[54] APPARATUS FOR MOUNTING FLAIL MEMBERS ON A ROTATABLE DRUM

[75] Inventors: Philip C. McCray; George B. Hammond, both of Montgomery, Ala.

[73] Assignee: Kershaw Manufacturing Company, Inc., Montgomery, Ala.

[21] Appl. No.: 17,939

[22] Filed: Mar. 6, 1979

[51] Int. Cl.[3] ..... B27L 1/00

[52] U.S. Cl. ..... 144/2 Z; 59/93; 144/208 J; 172/45; 241/194

[58] Field of Search ..... 59/86, 93, 95; 172/45; 144/2 Z, 208 R, 208 J; 241/193, 194

[56] References Cited

U.S. PATENT DOCUMENTS

| | | | |
|---|---|---|---|
| 1,552,498 | 9/1925 | Noyes | 144/208 J |
| 2,341,486 | 2/1944 | Swertfeger | 241/194 |
| 2,501,925 | 3/1950 | Yensen et al. | 144/208 J |
| 3,177,640 | 4/1965 | Mott, Jr. | 172/45 X |
| 3,950,941 | 4/1976 | Ohrn | 59/86 |

FOREIGN PATENT DOCUMENTS

| | | | |
|---|---|---|---|
| 964965 | 2/1974 | Canada | 144/208 J |

*Primary Examiner*—W. Donald Bray
*Attorney, Agent, or Firm*—Woodford R. Thompson, Jr.

[57] ABSTRACT

Flail members are mounted on a rotatable drum by providing a plurality of angularly spaced rows of longitudinally spaced openings in the drum. A tube rectangular in cross section extends through each opening and is secured rigidly to the drum for receiving a clevis with a sliding fit with the inner end of a flail member being attached to the clevis. Transverse openings through the walls of the tube and the legs of the clevis are aligned with each other in a direction longitudinally of the drum for receiving a rod which extends inwardly of the drum and longitudinally thereof. Detachable means locks the rod in place.

7 Claims, 6 Drawing Figures

FIG. 3
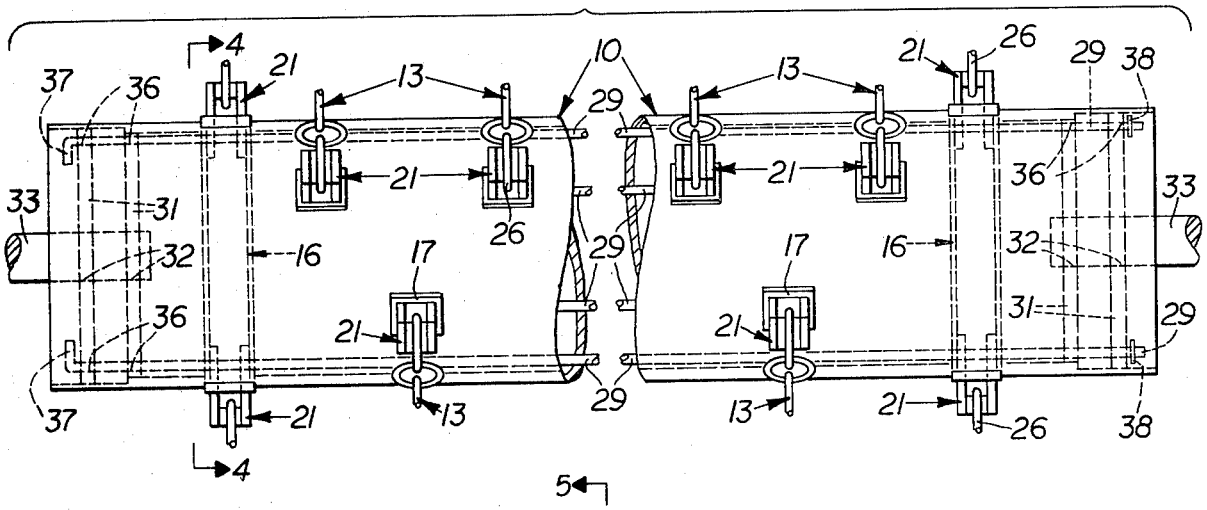
FIG. 4
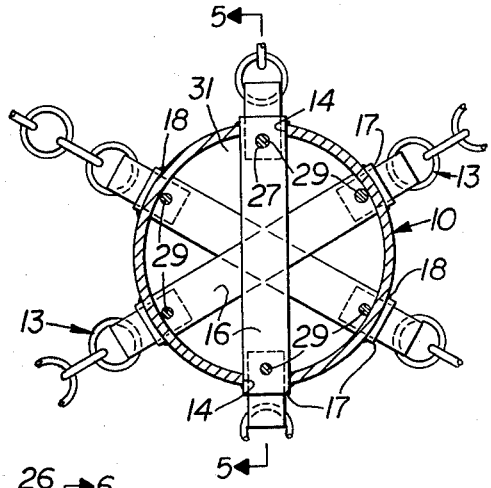
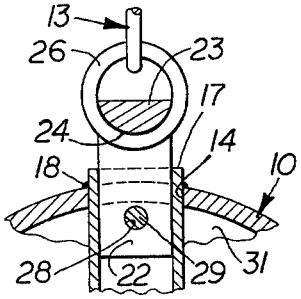
FIG. 6
FIG. 5
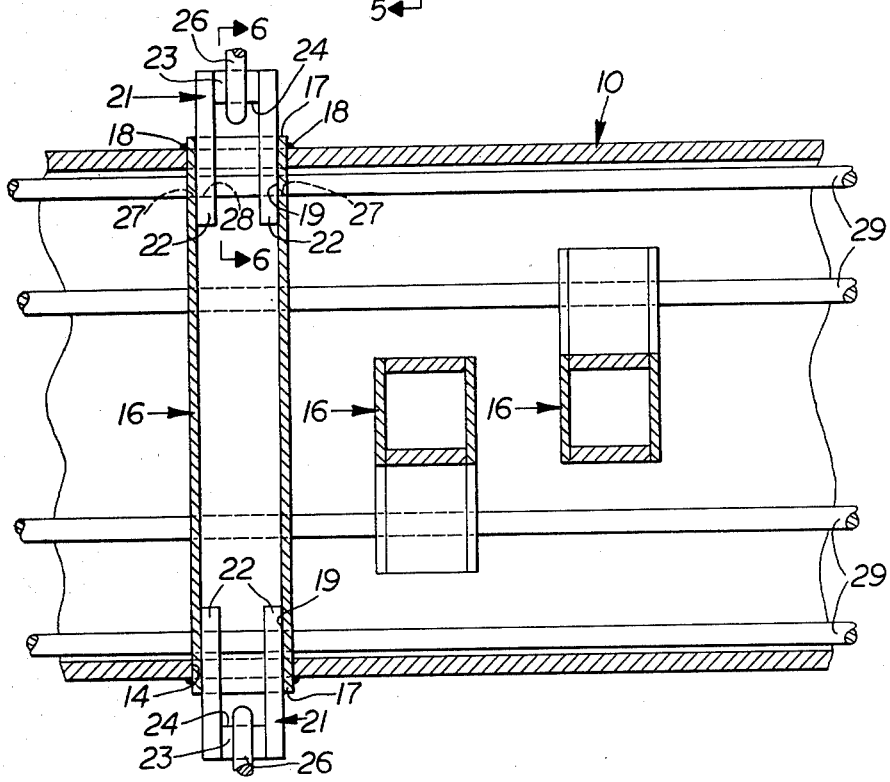

APPARATUS FOR MOUNTING FLAIL MEMBERS ON A ROTATABLE DRUM

BACKGROUND OF THE INVENTION

The invention relates to apparatus for mounting flail members on a drum adapted for rotation about its longitudinal axis and more particularly to improved means which eliminates excessive wear between the drum and the means attaching the flail member to the drum.

As is well known in the art to which our invention relates, many devices have been proposed for attaching the inner ends of flail delimber members to a rotary drum. For example, one method of attaching the inner end of flail members to a drum has been to weld spaced apart lugs directly to the wall of the flail drum and then mount the inner end of a member, such as a flail chain, by means of a bolt or pin between the lugs. Difficulties have been encountered with this method of attaching the flail member to the drum due to the fact that during normal use of the apparatus, the lugs, pins, and/or bolts are beaten and so badly distorted that removal and replacement of the chains is very difficult.

Another method of attaching flail members to a drum has been to insert a straight link chain through an elongated slot in the flail drum and then pass an elongated rod through the link chain to thus secure the flail chain in place. The problem with this design is that the chains rub against the wall of the flail drum and greatly enlarge the slots therein. Also, as this wear occurs, the chains are permitted to rotate on the retaining rods. This rotation causes slots to be worn in the rod of the same width as the width of the chain.

Another method of attaching a flail member to a rotary drum has been to employ a ring chain which is installed on a clevis shaped retainer which is installed loosely through a slot in the flail drum and is then secured in place by a rod which passes through the clevis. Problems have been encountered with this design similar to the problems mentioned above since the clevis retainers enlarge the slots in the flail drum, thus allowing the retainers to pivot on the rods whereby the rods are worn by the loose engagement with the clevis retainers.

The following patents show prior art type apparatus: U.S. Pat. No. 2,792,860, U.S. Pat. No. 2,831,317 and U.S. Pat. No. 2,893,451, and French Pat. No. 1,360,289.

SUMMARY OF THE INVENTION

In accordance with our invention, we overcome the above and other difficulties by providing a plurality of angularly spaced rows of longitudinally spaced openings in the flail drum at locations for attaching the flail members. Tubular members, rectangular in cross section, extend through each of the openings in the drum and are fixedly secured thereto by welding to form receptacles for clevis members which telescope into the tubular members with a close sliding fit whereby the clevis member is adapted to slide axially within the tubular member but is held against rotation relative to the tubular member. Aligned openings through the walls of the tubular members and the legs of the clevis members extend in a direction longitudinally of the drum in position to receive elongated rods which connect the clevis members to the tubular members. The inner end of a flail member is attached to each clevis member prior to installation of the clevis member whereby the flail members may be readily installed or removed by removing the elongated retainer rod whereby the clevis member may move axially relative to its tubular member.

BRIEF DESCRIPTION OF THE DRAWINGS

Apparatus embodying features of our invention is illustrated in the accompanying drawings, forming a part of this application, in which:

FIG. 3 is an enlarged, fragmental view, partly broken away and in section, showing the flail drum and the means for attaching the inner ends of the flail members thereto;

FIG. 4 is a sectional view taken generally along the line 4—4 of FIG. 3;

FIG. 5 is an enlarged, fragmental, sectional view taken generally along the line 5—5 of FIG. 4; and FIG. 6 is a sectional view taken generally along the line 6—6 of FIG. 5.

DETAILED DESCRIPTION

Figure 1:
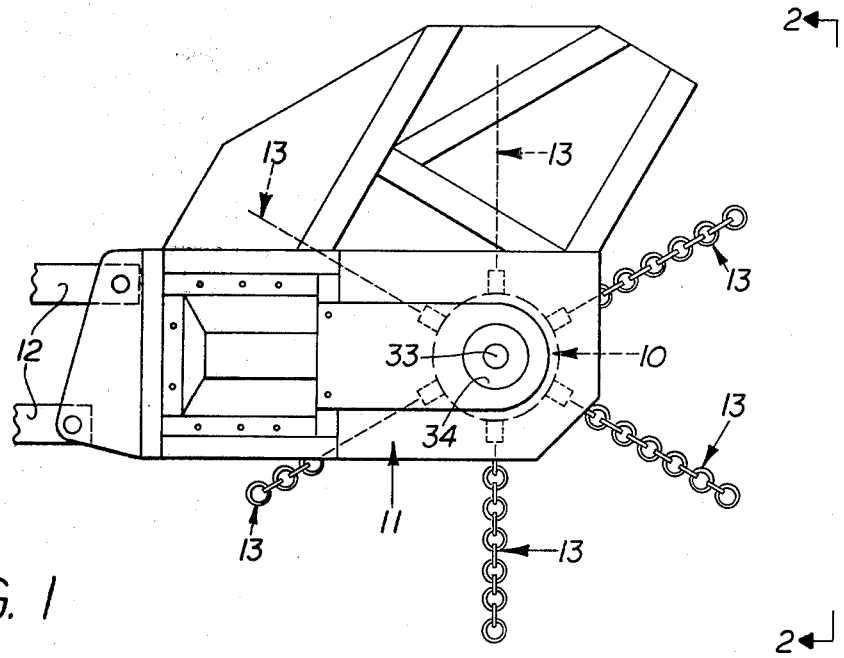
FIG. 1 is a side elevational view showing a fragment of a supporting boom for moving the apparatus to selected operating positions.
Figure 2:
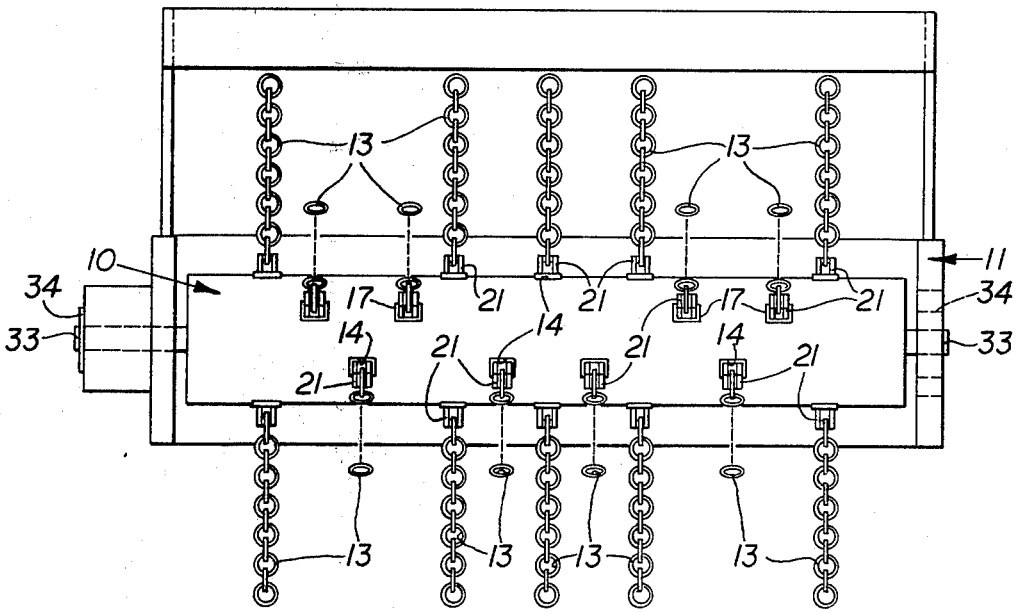
FIG. 2 is an elevational view taken generally along the line 2—2 of FIG. 1.

Referring now to the drawings for a better understanding of our invention, we show our improved delimber unit which embodies a rotatable drum 10 carried by a conventional type housing unit 11 mounted at the outer end of a movable boom 12 which in turn is carried by a suitable translatable frame, not shown. The drum 10 carries a plurality of radially extending flail members, such as chains 13, which are adapted to engage the limbs of a tree to thereby remove the limbs from the tree upon movement of the drum 10 adjacent the tree.

To attach the inner ends of the radially extending flail members 13 to the drum 10 we provide a plurality of angularly spaced rows of longitudinally spaced openings 14 in the drum 10 at locations for attaching the flail members 13. Preferably, each opening 14 in the drum 10 is diametrically opposite another opening 14, as shown. An elongated tubular member 16 extends through the drum 10, as clearly shown in FIGS. 4 and 5, with its end portions 17 extending through the openings 14 which are diametrically opposite each other. Preferably, the tubular member 16 is rectangular, as viewed in cross section, throughout its length and each opening 14 is also of a rectangular shape corresponding to the shape of the outer surface of the end portions 17 of the tubular member 16. The end portions 17 of the tubular member 16 are secured rigidly to the drum 10 as by welding at 18. The end portions 17 of the tubular member 16 thus provide tubular members which extend through the openings 14 in the drum 10 and toward the longitudinal axis thereof to provide receptacles 19 at the outer ends of the end portions 17 which are rectangular, as viewed in cross section.

Mounted for sliding movement within each receptacle 19 is a clevis member 21 having parallel legs 22 which engage the inner surface of the receptacle 19 with a close fit, as shown. The outer ends of the legs 22 of the clevis 21 are connected to a transverse base member 23. As clearly shown in FIG. 6, the base portion 23 of the clevis member 21 has a convex inner surface 24 between the legs 22 for receiving a link-like element 26 of the flail member 13. That is, the inner surface of the link-like member 26 corresponds generally to the arcuate or convex inner surface of the base member 23 of the clevis 21.

Transverse, aligned openings 27 are provided through the walls of each tubular outer section 17 inwardly of the drum 10 and are aligned with each other in a direction longitudinally of the drum 10, as shown. Transverse, aligned openings 28 are provided through the legs 22 of each clevis member 21 in alignment with the adjacent aligned openings 27 through the walls of the tubular outer sections 17. That is, the transverse openings 28 are also aligned with each other in a direction longitudinally of the drum 10.

Extending longitudinally and inwardly of the inner surface of the drum 10 and through the transverse aligned openings 28 through the clevis members and the aligned openings 27 through the tubular outer sections 17 in each row of openings 14 in the drum 10 is a rod-like member 29 which secures each clevis member 21 to its tubular outer section 17, as clearly shown in FIGS. 4, 5 and 6. As shown in FIG. 3, disc-like heads 31 are mounted within each end of the drum 10 and are fixedly secured thereto. Extending through suitable openings 32 through the heads 31 at each end of the drum 10 is a stub shaft 33 which supports the drum 10 for rotation in suitable bearing units 34 carried by the housing 11, as shown in FIG. 1. Angularly spaced openings 36 are provided through each of the heads 31 for passing the rod-like members 29. Axial movement of the rod-like member 29 relative to the heads 31 may be limited by suitable means, such as by bending one end of each rod 29 to provide a laterally extending projection 37 which extends alongside the adjacent head 31, as shown in FIG. 3. The opposite end of each rod-like member 29 is provided with a suitable opening therethrough for receiving a suitable locking pin, such as a cotter pin 38. It will be apparent to one skilled in the art that other means may be employed to limit axial movement of the rod-like member 29 relative to the heads 31.

As shown in FIGS. 1 and 4, the angular distance between adjacent ones of the angularly spaced rows of longitudinally spaced openings 14 in the drum 10 are all equal to each other to provide a rotatable unit which is dynamically balanced.

From the foregoing description, the operation of our improved apparatus will be readily understood. To assemble the apparatus, the tubular members 16 are inserted through oppositely disposed openings 14 in the drum 10 and are then welded in place as at 18. The flail members, such as the chains 13, are attached to the clevis members 21 with the innermost link-like element of the flail member engaging the convex inner surface 24 of the base portion 23 of the clevis member 21. The clevis members 21 are then inserted into the outer ends of the tubular outer sections 17 whereby the legs 22 of each clevis member 21 engages the inner surface of its tubular outer section 17 with a snug fit. Accordingly, the clevis member 21 is adapted for longitudinal movement relative to its tubular outer section 17 but is held against rotation relative thereto. The clevis members 21 are moved inwardly of the tubular outer sections 17 until the openings 28 in each clevis member 21 move into alignment with the transverse aligned openings 27 provided in the tubular outer section 17. The rod-like member 29 is then inserted through the transverse aligned openings through the clevis members and tubular members in each row of openings 14 in the drum 10 to thus secure each clevis member 21 to its associated tubular outer section 17. The rod-like members 29 are then locked in place by the locking pins 38.

From the foregoing, it will be seen that we have devised improved apparatus for mounting flail members, such as delimber members, on a rotating drum. By providing aligned rows of openings 14 for receiving the tubular sections 17 which are rectangular as viewed in cross section and securing said tubular sections rigidly to the drum, we provide a separate receptacle for receiving such clevis member with a close sliding fit. Since the inner surface of each tubular section 17 is rectangular, as viewed in cross section and the adjacent outer surfaces of the clevis member 21 are of a similar shape, the clevis member 21 cannot rotate relative to the tubular section 17. Also, since the rod-like member 29 passes through the aligned openings through the clevis members and the tubular members in each row of openings 14 in the drum 10, the clevis members 21 cannot rotate relative to the rod-like member 29, thus greatly reducing the amount of wear between the connected parts. Furthermore, by providing rod-like members 29 which may be readily inserted into or removed from the aligned openings through the clevis members and the tubular sections 17, the flail members 13 may be installed or removed with a minimum of time and effort.

While we have shown our invention in but one form, it will be obvious to those skilled in the art that it is not so limited, but is susceptible of various changes and modifications without departing from the spirit thereof.

What we claim is:

1. Apparatus for mounting flail members on a drum with said drum being adapted for rotation about its longitudinal axis comprising:

(a) a plurality of circumferential angularly spaced rows of openings in said drum with the openings of each row being spaced longitudinally of said drum at locations for attaching flail members, (b) a tubular member rectangular as viewed in cross section extending through each of said openings in said drum and toward the longitudinal axis of said drum, (c) means securing each said tubular member rigidly to said drum, (d) a clevis member having parallel legs extending inwardly of each said tubular member with a sliding fit, (e) transverse aligned openings through the walls of each tubular member inwardly of said drum and aligned with each other in a direction longitudinally of said drum, (f) transverse aligned openings through said legs of each said clevis member adapted to move into alignment with adjacent aligned openings through said walls of said tubular member, (g) a rod-like member extending longitudinally and inwardly of the inner surface of said drum and through said transverse aligned openings through said clevis members and said tubular members in each said row of openings in said drum to secure each said clevis member to its tubular member, and (h) means to attach the inner end of a flail member to each said clevis member.

2. Apparatus for mounting flail members on a drum as defined in claim 1 in which each said opening in said drum is diametrically opposite another said opening in said drum and a common tubular member extends therebetween with the ends of said common tubular member being rectangular in cross section and secured rigidly to said drum to define said tubular members which extend through openings in said drum.

3. Apparatus for mounting flail members on a drum as defined in claim 2 in which said common tubular member is rectangular in cross section throughout the length thereof.

4. Apparatus for mounting flail members on a drum as defined in claim 1 in which the angular distances between adjacent ones of said angularly spaced rows of longitudinally spaced openings in said drum are all equal to each other.

5. Apparatus for mounting flail members on a drum as defined in claim 1 in which said parallel legs of said clevis member are secured to a transverse base portion having a convex inner surface between said legs for receiving a link-like element carried by the inner end of a flail member.

6. Apparatus for mounting flail members on a drum as defined in claim 5 in which said flail members are in the form of chains.

7. Apparatus for mounting flail members on a drum as defined in claim 1 in which said drum has at least one head adjacent each end thereof and angularly spaced openings are provided through each head for passing the rod-like members and means detachably connects each said rod-like member to at least one said head to limit axial movement of said rod-like member relative thereto whereby the rod-like members are locked in place.

* * * * *